US012420213B2

(12) United States Patent
Helmick et al.

(10) Patent No.: US 12,420,213 B2
(45) Date of Patent: Sep. 23, 2025

(54) SYSTEM AND METHOD FOR COSTUMED CHARACTER INTERACTION

(71) Applicant: Universal City Studios LLC, Universal City, CA (US)

(72) Inventors: Nathaniel David Helmick, Winter Park, FL (US); Katherine Amanda Novak, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 622 days.

(21) Appl. No.: 17/901,544

(22) Filed: Sep. 1, 2022

(65) Prior Publication Data

US 2024/0075401 A1 Mar. 7, 2024

(51) Int. Cl.
*A63J 5/02* (2006.01)
*A63J 1/02* (2006.01)

(52) U.S. Cl.
CPC .. *A63J 5/02* (2013.01); *A63J 1/02* (2013.01)

(58) Field of Classification Search
CPC ..... A63J 1/02
USPC ..... 446/26–28, 330–368; 472/81, 83
See application file for complete search history.

(56) References Cited

U.S. PATENT DOCUMENTS 1,554,650 A * 9/1925 Petching ..... A63J 5/02 472/81
4,662,628 A * 5/1987 Chatenay epouse Compagnone ..... A63J 1/028 254/278
2002/0077024 A1* 6/2002 Choi ..... A63H 11/00 446/357
2010/0144239 A1 6/2010 Eck et al.
2010/0227527 A1* 9/2010 Smoot ..... A63F 9/34 446/362
2012/0164910 A1 6/2012 Dilworth et al.
2012/0239200 A1* 9/2012 Menard ..... H04N 21/4302 700/275
2014/0315468 A1* 10/2014 Vasquez ..... A63H 13/02 446/354
2016/0001193 A1 1/2016 Eck et al.
2017/0192517 A1* 7/2017 Hygh ..... A63F 13/212
2018/0214755 A1* 8/2018 Villalba ..... A63B 67/08
2019/0384390 A1* 12/2019 Cruz Hernandez ..... A41D 19/0024
2021/0103421 A1* 4/2021 Chang ..... G06F 3/011
(Continued)

FOREIGN PATENT DOCUMENTS

DE 202021106635 U1 * 3/2022 ..... A63F 9/0641
WO WO-2023098411 A1 * 6/2023 ..... A63J 25/00

OTHER PUBLICATIONS

PCT/US2023/031436 International Search Report and Written Opinion mailed Nov. 29, 2023.

*Primary Examiner* — Morgan T Jordan
(74) *Attorney, Agent, or Firm* — Fletcher Yoder, P.C.

(57) ABSTRACT

A system for controlling costumed character interaction includes a character costume configured to be worn by a user. The character costume includes an electromagnet integrated into the character costume. The system also includes a stage prop including a magnetic piece integrated into the stage prop. The system further includes a control interface coupled to the electromagnet. The control interface is configured, via a control signal, to activate and to deactivate the electromagnet to control interaction between the character costume and the stage prop via magnetic interaction between the electromagnet and the magnetic piece.

20 Claims, 4 Drawing Sheets

(56) References Cited

U.S. PATENT DOCUMENTS

| | | | | |
|---|---|---|---|---|
| 2022/0000192 | A1 | 1/2022 | Musser | |
| 2022/0184512 | A1* | 6/2022 | Freedman | A63J 1/00 |
| 2023/0117665 | A1* | 4/2023 | Ciapala-Hazlerig | H05B 47/155 315/297 |
| 2023/0364525 | A1* | 11/2023 | Kauffmann | A63H 33/009 |

* cited by examiner

SYSTEM AND METHOD FOR COSTUMED CHARACTER INTERACTION

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

In many entertainment venues and settings, there is a desire for costumed and themed character outfits for entertainers. These costumes can range from a simple paper mask to a fully customized themed performer suit requiring prosthetics and extensions to a performer's limbs to closely mimic the desired character. Many times, these costumes limit the entertainer's ability to utilize the costume's or character's appendages (e.g., hand) to realistically interact with their surroundings. Accordingly, it may be desirable to provide a system to improve the costumed entertainer's interaction with their surroundings.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a system for controlling costumed character interaction includes a character costume configured to be worn by a user. The character costume includes an electromagnet integrated into the character costume. The system also includes a stage prop including a magnetic piece integrated into the stage prop. The system further includes a control interface coupled to the electromagnet. The control interface is configured, via a control signal, to activate and to deactivate the electromagnet to control interaction between the character costume and the stage prop via magnetic interaction between the electromagnet and the magnetic piece.

In an embodiment, a system for controlling costumed character interaction includes a character costume configured to be worn by a user. The character costume includes magnetic piece integrated into the character costume. The system also includes a stage prop including an electromagnet integrated into the stage prop. The system further includes a control interface coupled to the electromagnet. The control interface is configured, via a control signal, to activate and to deactivate the electromagnet to control interaction between the stage prop and the character costume via magnetic interaction between the electromagnet and the magnetic piece.

In an embodiment, a method for controlling costumed character interaction includes providing, via a control interface, a control signal to an electromagnet integrated into a character costume worn by a user. The method also includes in response to the control signal, causing the electromagnet either to activate or to deactivate to control interaction between the character costume and a stage prop including a magnetic piece via magnetic interaction between the electromagnet and the magnetic piece.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
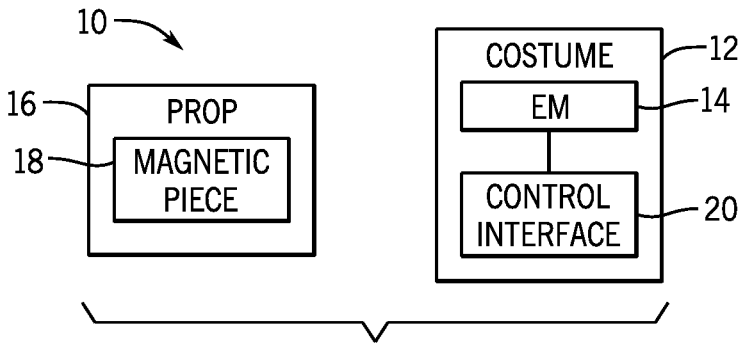
FIG. 1 is a schematic view of a system for controlling costumed character interaction (e.g., having a costume with an electromagnet and a stage prop with a magnetic piece), in accordance with aspects of the present disclosure.

The present disclosure relates generally to costumed or themed character outfits for entertainers. More specifically, embodiments of the present disclosure relate to utilization of electromagnetic locks for costumed character interaction.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments of the disclosure are directed to systems and methods for controlling costumed character interaction, in particular, utilizing electromagnetic locks (e.g., formed between electromagnets and magnetic pieces) for costumed character interaction. For example, a character costume worn by a person (e.g., entertainer) may include an electromagnet integrated in the character costume. A complementary magnetic piece (e.g., permanent magnet or ferromagnetic material) integrated into a stage prop (e.g., theatrical property) or show piece. In certain embodiments, the stage prop or show piece (e.g., gate to a fence, door on a house, gear attached to a wall, etc.) may be part of the scene or stage. In response to a control signal from a control interface (e.g., switch, sensor, or device having circuitry or other hardware providing control signal) communicatively coupled (e.g., via a wired or wireless connection) to the electromagnet, the electromagnet may be activated or deactivated (e.g., turned on or off) to control interaction between the character costume (e.g., an appendage of the character costume) and the stage prop or show piece via the magnetic interaction between the electromagnet and the magnetic piece. In certain embodiments, the arrangement may be reversed, where the stage prop or show piece has the electromagnet and the character costume includes the complementary magnetic piece. When engaged together, the electromagnet and the complementary magnetic piece form an electromagnetic lock. In certain embodiments, a combination of electromagnets and complementary magnetic pieces may enable interaction between multiple props and interaction between the multiple props and the character costume. In certain embodiments, the character costume and/or the stage prop or show piece may include more than one of the electromagnets and/or magnetic pieces. In certain embodiments, the character costume and/or the stage prop or show piece may include at least one each of an electromagnet and a magnetic piece. The disclosed systems and methods will make it easier for the entertainer (e.g., within the character costume) to interact with their surroundings. In addition, the disclosed systems and methods broaden the types of interactions the entertainer may have with their surroundings.

FIG. 1 is a schematic view of a system 10 for controlling costumed character interaction (e.g., having a costume 12 with an electromagnet 14 and a stage prop 16 with a magnetic piece 18). The system 10 includes a character costume 12 configured to be worn by a person (e.g., entertainer or performer). Person as utilized in the following disclosure may include a living being (e.g., human or animal) or a robot. In certain embodiments, the character costume 12 may include prosthetics and/or extensions coupled to the person's appendages or other body part to enable the character costume 12 to closely resemble a desired character. The character costume 12 may be configured to enable the person to interact with (e.g., hold, manipulate, etc.) one or more stage props or show pieces 16. In certain embodiments, the stage props 16 may be an integral part of a scene or stage. For example, the stage prop 16 may be a gate to a fence, door on a house, a gear attached to a wall, or some other item. In certain embodiments, the stage props 16 may be stand-alone.

As depicted in FIG. 1, the stage prop 16 includes the magnetic piece 18. The magnetic piece 18 may be a permanent magnet or made of a ferromagnetic material. The magnetic piece 18 may be in the form of a plate (e.g., armature plate) or strip integrated within the stage prop 16. The magnetic piece 18 may be placed in a location of the stage prop 16 that enables normal interaction (or the appearance of normal interaction) of the character costume 12 with the stage prop 16. For example, if the stage prop 16 is a fishing pole, the magnetic piece 18 may be located in the handle of the fishing pole. In certain embodiments, the stage prop 16 may include more than one magnetic piece 18. In certain embodiments, multiple stage props 16 may each include one or more respective magnetic pieces 18.

The electromagnet 14 is integrated within the character costume 12. The electromagnet 14 may be disposed in an appendage of the character costume 12 (e.g., hand, foot, arm, leg) or another portion of the character costume 12 (e.g., torso, head, etc.). In certain embodiments, the character costume 12 may include multiple electromagnet 14 located in different locations of the character costume 12.

As depicted, the electromagnet 14 is coupled to a control interface 20 (e.g., a switch). In certain embodiments, the electromagnet 14 may be coupled to the control interface 20 via a wireless connection. In certain embodiments, the electromagnet 14 may be coupled to the control interface 20 via a wired connection. As depicted, the control interface 20 (e.g., switch, sensor, or device having circuitry or other hardware providing control signal) is disposed in the character costume 12. In certain embodiments, the control interface 20 may be a switch or sensor, integrated into a portion of the character costume 12 where a particular movement may cause the control interface 20 to provide control signals to turn the electromagnet 14 on or off. For example, a switch or sensor(s) may be integrated in the fingers or grip of a hand where movement of the hand and/or fingers (e.g., clenching) that mimics gripping may trigger a control signal. In another embodiment, a switch or sensors, may be integrated in a neck or head region and may be activated by moment of the head. In certain embodiments, the control interface 20 is located outside or remote from the character costume 12. For example, the control interface 20 may be part of a device controlled by a handler of the entertainer. The control interface 20 is configured (via a control signal) to activate and to deactivate the electromagnet 14 to control interaction between the character costume 12 and the stage prop 16 via magnetic interaction between the electromagnet 14 and the magnetic piece 18. In certain embodiments, upon activation of the electromagnet 14, the electromagnet 14 of the character costume 12 and the magnetic piece 18 of the stage prop 16 engage each other forming an electromagnetic lock (while deactivation disengages the electromagnet 14 and the magnetic piece 18). In certain embodiments, upon activation of the electromagnet 14, the electromagnet 14 of the character costume 12 and the magnetic piece 18 of the stage prop 16 disengage from each other.

When disposed within the character costume 12, the control interface 20 may be generally located in the same location as the electromagnet 14. For example, if the electromagnet 14 is located in the hand of the character costume 12, the control interface 20 may be located near the hand region in the arm. In certain embodiments, the control interface 20 may be located in the character costume 12 in a different location from the electromagnet 14. For example, if the electromagnet 14 is located in the hand of the character costume 12, the control interface 20 may be located in the torso region or the neck region. In certain embodiments, the control interface 20 may be directly manipulated by a hand or foot of the person within the character costume 12. In certain embodiments, the control interface 20 may be manipulated by the entertainer externally pressing a portion of the character costume 12 where the control interface 20 is located (e.g., chest, forearm, etc.). In certain, embodiments, the control interface 20 is located in a region where movement enables sending control signals to the electromagnet 14. For example, the control interface 20 may be located in the neck region of the character costume 12 and rotation of the head or nodding of the head may enable the sending of control signals from the control interface 20.

Figure 2:
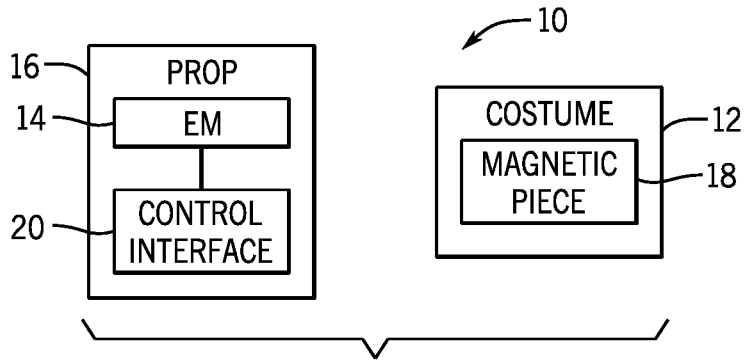
FIG. 2 is a schematic view of a system for controlling costumed character interaction (e.g., having a costume with a magnetic piece and a stage prop with an electromagnet), in accordance with aspects of the present disclosure.

FIG. 2 is a schematic view of the system 10 for controlling costumed character interaction having the opposite arrangement. As depicted in FIG. 2, the character costume 12 includes the magnetic piece 18. As noted above, the magnetic piece 18 may be a permanent magnet or made of a ferromagnetic material. The magnetic piece 18 may be in the form of a plate or strip integrated within the character costume 12. The magnetic piece 18 may be placed in a location of the character costume 12 that enables normal interaction (or the appearance of normal interaction) of the character costume 12 with the stage prop or show piece 16. For example, if the stage prop 16 is a baseball bat, the magnetic piece 18 may be located in the hand of the character costume 12. In certain embodiments, the character costume 12 may include more than one magnetic piece 18. The magnetic piece 18 may be disposed in an appendage of the character costume 12 (e.g. hand, foot, arm, leg) or another portion of the character costume 12 (e.g., torso, head, etc.). In certain embodiments, the character costume 12 may include multiple magnets located in different locations of the character costume 12.

The electromagnet 14 is integrated within the stage prop 16. The electromagnet 14 may be disposed in or on a location of the stage prop 16 that enables normal interaction (or the appearance of normal interaction) of the character costume 12 with the stage prop or show piece 16. For example, if the stage prop 16 is a baseball bat, the electromagnet 14 may be located in the handle of the baseball bat. In certain embodiments, the stage prop 16 may include multiple electromagnets 14 located in different locations of the stage prop 16.

As depicted, the electromagnet 14 is coupled to the control interface 20 (e.g., a switch). In certain embodiments, the electromagnet 14 may be coupled to the control interface 20 via a wireless connection. In certain embodiments, the electromagnet 14 may be coupled to the control interface 20 via a wired connection. As depicted, the control interface 20 is disposed in the stage prop 16. In certain embodiments, the control interface 20 is located outside or remote from the stage prop 16. For example, the control interface 20 may be part of a device controlled by a handler of the entertainer. The control interface 20 is configured (via a control signal) to activate and to deactivate the electromagnet 14 to control interaction between the character costume 12 and the stage prop 16 via the magnetic interaction between the electromagnet 14 and the magnetic piece 18. In certain embodiments, upon activation of the electromagnet 14, the electromagnet 14 of the stage prop 16 and the magnetic piece 18 of the character costume 12 engage each other (e.g., forming an electromagnetic lock). In certain embodiments, upon activation of the electromagnet 14, the electromagnet 14 of the stage prop 16 and the magnetic piece 18 of the character costume disengage from each other.

In certain embodiments, it may be preferable to have the magnetic piece 18 made of ferromagnetic material (e.g., a piece of metal such as a plate that is ferromagnetic). However, in certain embodiments, the magnetic piece 18 may be a permanent magnet. In certain embodiments, a permanent magnet may not be strong enough on its own to interact with the electromagnet 14 (e.g., in the character costume 12) and the activation of the electromagnet 14 would generate a greater attraction between the electromagnet and the permanent magnet to generate an electromagnetic lock. In certain embodiments, due to permanent magnets typically having two poles, the permanent magnet may be arranged in the costume and/or stage prop 16 so that a particular pole is oriented to generate a specific action (e.g., repulsion or attraction) between stage props 16 or between the stage prop 16 and the character costume 12. In certain embodiments, due to a thickness of the character costume 12, a couple of electromagnets 14 may be utilized to form an electromagnetic lock 14 with the magnetic piece 18. In certain embodiments, the magnetic piece 18 itself may be an electromagnet.

Figure 3:
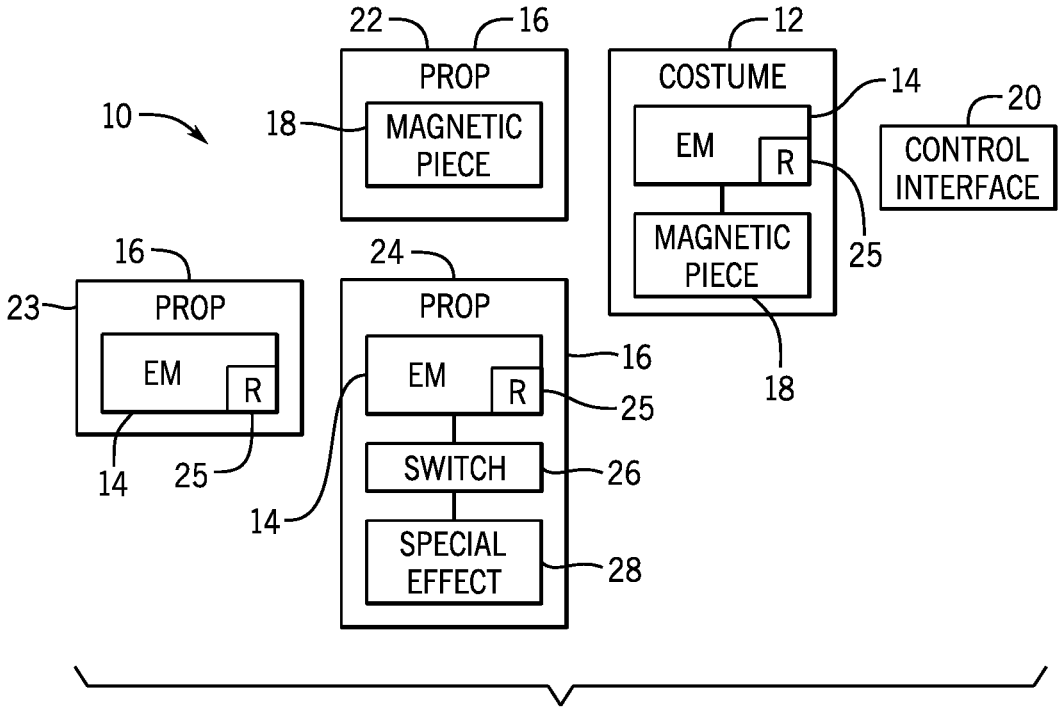
FIG. 3 is a schematic view of a system for controlling costumed character interaction (e.g., having a costume and different stage props with various combinations of magnetic pieces and electromagnets), in accordance with aspects of the present disclosure.

FIG. 3 is a schematic view of the system 10 for controlling costumed character interaction (e.g., having the costume 12 and different stage props 16 with various combinations of magnetic pieces 18 and electromagnets 14). As depicted in FIG. 3, some stage props 16 (e.g., stage prop 22) include the magnetic piece 18, while other stage props 16 (e.g., stage props 23, 24) include the electromagnet 14. Certain stage props 16 (e.g., the stage prop 24) includes the electromagnet 14 coupled to a switch 26. The switch 26 is coupled to a special effect generator 28 (e.g., special effect device). The special effect generator 28 may be activated via or based on a magnetic coupling between the electromagnet 14 and the magnetic piece 18 (e.g., the magnetic coupling may be detected or otherwise result in an activation signal). In one embodiment, a control signal from the control interface 20 may increase in strength to trigger the switch 26 to activate the special effect generator 28. This may occur after a controlled time delay. The special effect generator 28 may be an item that rotates (e.g., a wheel of a pinwheel toy or a saw blade on a saw), a light effect (e.g., LED lights for a flame on a torch), confetti being shot out of the stage prop 16, or any other type of special effect generator 28. In certain embodiments, some stage props 16 may include one or more of the magnetic pieces 18 and one or more of the electromagnets 14. In certain embodiments, multiple stage props 16 may directly interact with each other and the interaction (via various combinations of the various electromagnets 14 and magnetic pieces 18) may be controlled via one or more control interfaces 20. The multiple interacting stage props 16 may also interact with the character costume 12. For example, the electromagnet 14 of the character costume 12 (e.g., located in a hand of the character costume 12) may be utilized to interact with the stage prop 22 (e.g., a fishing rod having a first magnetic piece 18 located in a handle and a second magnetic piece 18 located in a hook on the end of a fishing line of the fishing rod). The stage prop 22 (e.g., the hook on the end of the fishing line of the fishing rod) may interact with the stage prop 23 having the electromagnet 14 (e.g., a fish).

As depicted in FIG. 3, the character costume 12 includes the magnetic piece 18. In addition, the character costume 12 includes the electromagnet 14. Thus, the character costume 12 may interact with stage props 16 (e.g., stage prop 22) that include the magnetic piece 18 via the electromagnet 14 within the character costume 12. In addition, the character costume 12 may also interact with stage props 16 (e.g., stage props 23, 24) that include the electromagnet 14.

The system 10 may include one or more control interfaces 20. As depicted in FIG. 3, the control interface 20 is located remote from the stage props 16 and the character costume 12. The electromagnets 14 each include a receiver 25 for receiving wireless control signals from the control interface 20. In certain embodiments, each respective electromagnets 14 (in the character costume 12 and the stage props 16) may be controlled by respective control interfaces 20 (e.g., on separate control devices). In certain embodiments, multiple electromagnets 14 may be controlled by a single control interface 20 as part of a single control device. In certain embodiments, the character costume 12 and/or one or more of the stage props 16 may have remote control interfaces 20, while others have the control interface 20 disposed within the stage prop 16 and/or the character costume 12.

Figure 4:
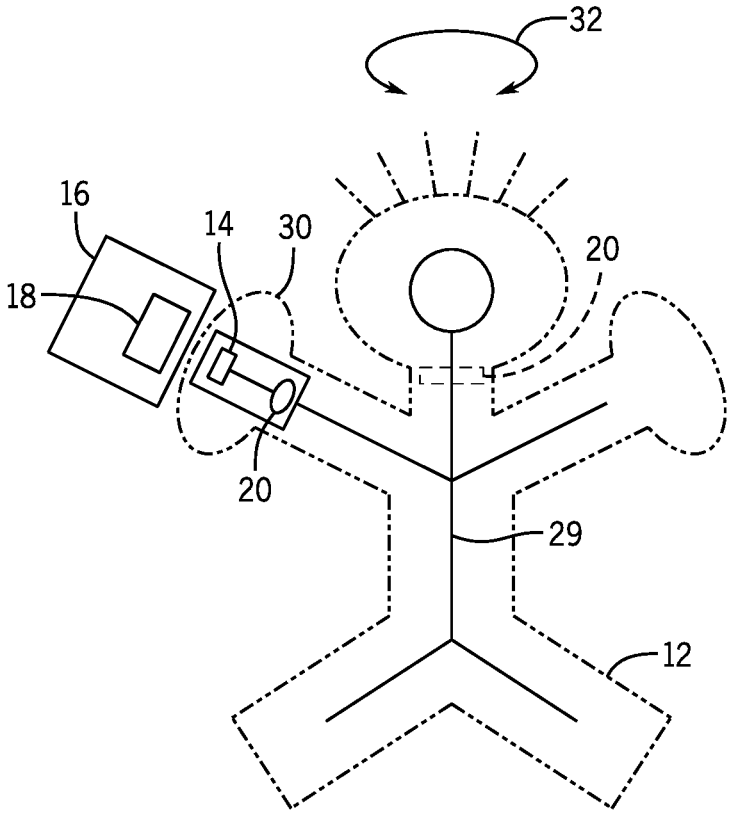
FIG. 4 is a schematic view of a character costume having an electromagnet, in accordance with aspects of the present disclosure.

FIG. 4 is schematic view of the character costume 12 having the electromagnet 14. The character costume 12 has a person 29 (e.g., entertainer) disposed within the costume 12. As depicted, the electromagnet 14 is disposed within a hand 30 of the character costume 12. In certain embodiments, the electromagnet 14 may be disposed within another portion of the character costume 12 (e.g., foot, arm, leg, head, torso, some extension of the costume 12, etc.). The electromagnet 14 is coupled to the control interface 20 (e.g., via wired connection). The control interface 20 may be actuated via manipulation by the person 29 (e.g., via a hand of the person) within the character costume 12. In certain embodiments, the electromagnet 14 may be wirelessly coupled to the control interface 20. For example, as depicted in FIG. 4, the control interface 20 may be disposed in the head/neck region so that movement of the head (e.g., rotational movement 32) may actuate the control interface 20 to send wireless control signals to control the electromagnet 14. As depicted in FIG. 4, the electromagnet 14 is activated to engage with the stage prop 16 (e.g. book) so that hand 30 of the character costume 12 is holding the stage prop 16.

Figure 5:
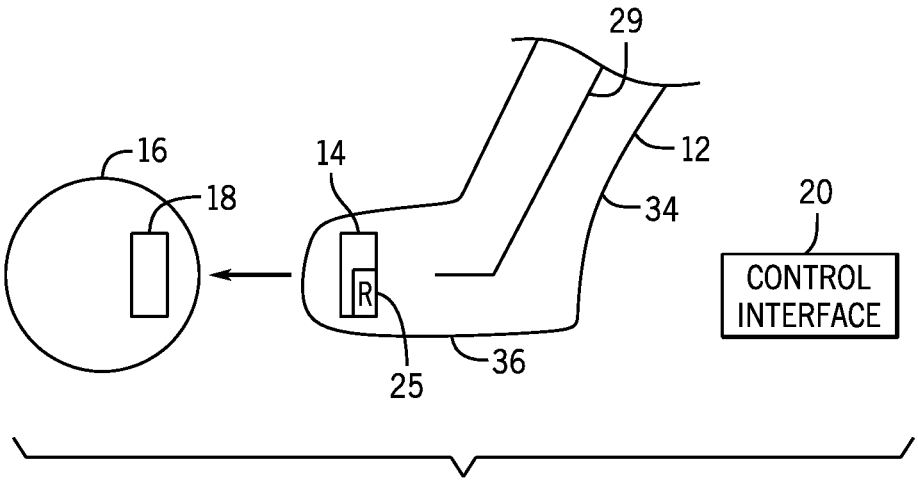
FIG. 5 is a schematic view of a portion of a character costume interacting with a stage prop, in accordance with aspects of the present disclosure.

FIG. 5 is a schematic view of a portion 34 of the character costume interacting with the stage prop 16. In certain embodiments, activation of the electromagnet 14 may cause the stage prop 16 to be repulsed from the electromagnet 14 by opposing magnetic forces. In FIG. 5, the electromagnet 14 is located within a foot 36 of the character costume 12 and the magnetic piece 18 is located with the stage prop 16 (e.g., a ball). With control signals (e.g., wireless control signals) from the control interface 20 received by the receiver 25 coupled to the electromagnet 14, the electromagnet 14 may be activated (e.g., provided electrical power) each time the foot 36 gets near the stage prop 16 causing the stage prop 16 (e.g., the ball) to repulse from the foot 36 based opposing magnetic forces to make it appear as if the foot 36 is kicking the stage prop 16.

Figure 6:
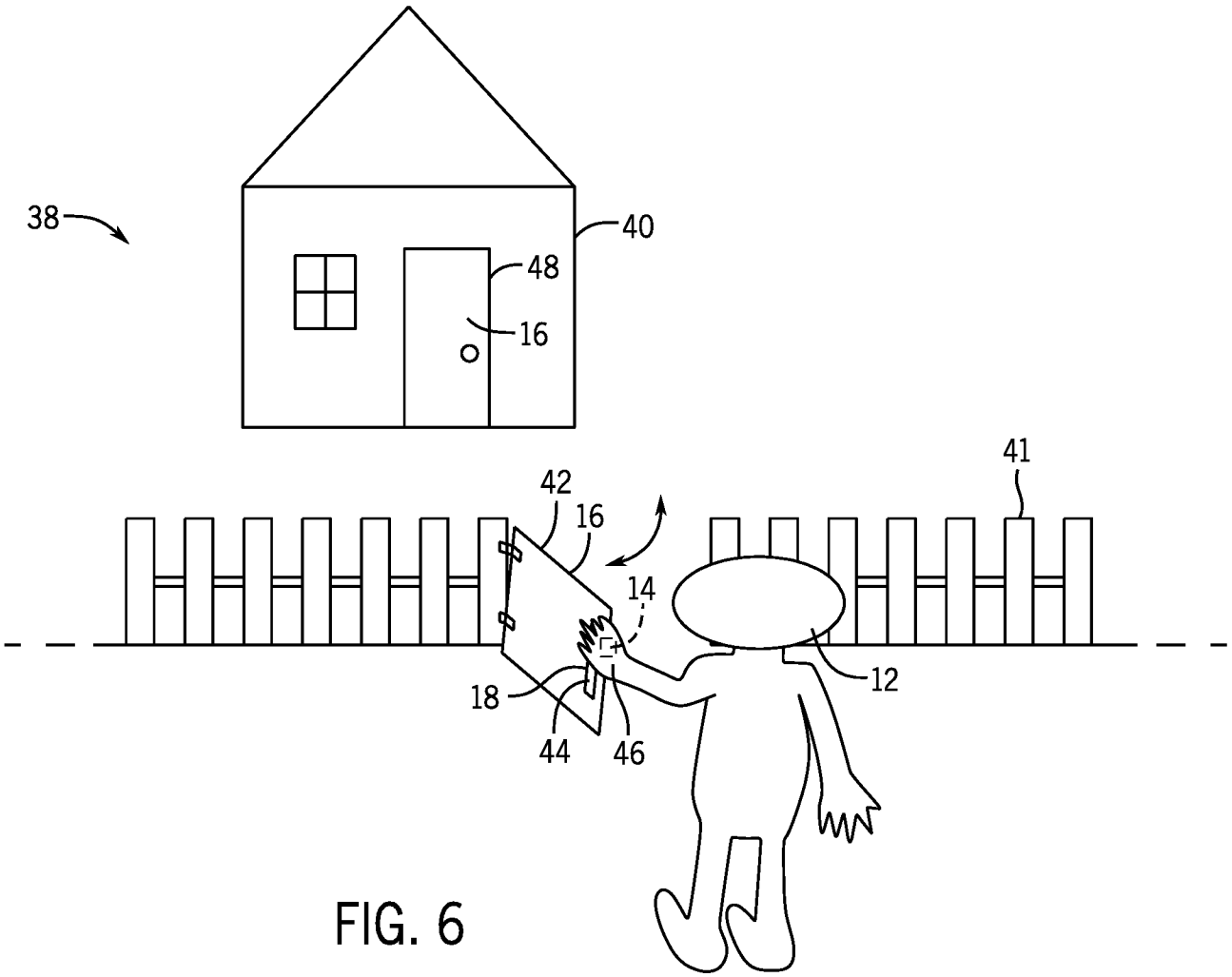
FIG. 6 is a schematic view of a character costume interacting with stage props in a scene, in accordance with aspects of the present disclosure.

FIG. 6 is a schematic view of the character costume 12 interacting with stage props 16 that are part of scenery 38 on a stage. The scenery 38 includes a house disposed behind a fence 41. As depicted, the entertainer in the character costume 12 is able to open or close a gate 42 (e.g., stage prop 16) of the fence 41 via an interaction between an electromagnet 14 and a magnetic piece 18 as described above (e.g., via control signals from a control interface 20). For example, a magnetic piece 18 may be located in a handle 44 of the gate 42 and an electromagnet 14 located in a hand 46 of the character costume 12. Alternatively, an electromagnet 14 may be located in the handle 44 and a magnetic piece 18 located in the hand 46 of the character costume 12. The door 48 of the house 40 may be another stage prop 16. For example, the entertainer in the character costume 12 may be able to open or close the door 48 of the house 40 utilizing a combination of an electromagnet 14 and a magnet.

Figure 7:
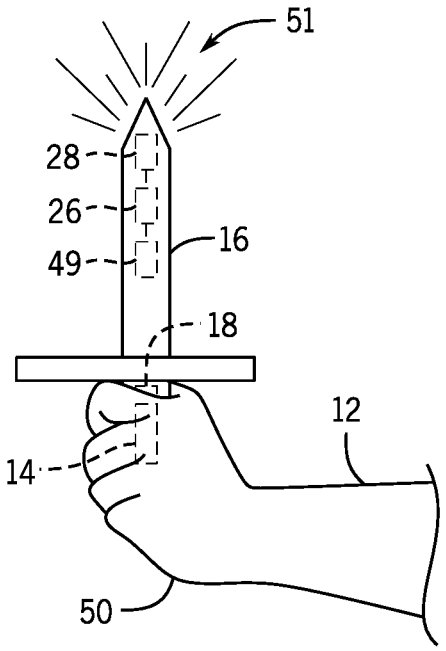
FIG. 7 is a schematic view of a portion of a character costume interacting with a stage prop with a special effect generator, in accordance with aspects of the present disclosure.

FIG. 7 is a schematic view of a portion of the character costume 12 interacting with the stage prop 16 with the special effect generator 28. As depicted in FIG. 7, the hand 50 of the character costume 12 is interacting with (e.g., holding) the stage prop 16 (e.g., sword) via a combination of electromagnet 14 and magnetic piece 18 interaction as described above. For example, the magnetic piece 18 may be located in the stage prop 16 (e.g., handle of the sword) and an electromagnet 14 located in a hand 50 of the character costume 12. Alternatively, an electromagnet 14 may be located in the stage prop 16 (e.g., handle of the sword) and the magnetic piece 18 located in the hand 50 of the character costume 12. An additional electromagnet 49 may be disposed in or on the stage prop 16 which is coupled to a switch coupled to the special effect generator 28 (e.g., spark emitting device) to generate a special effect 51. Upon activation of the additional electromagnet 49 to a certain strength, the special effect generator 28 (e.g., emission of sparks) may be activated. In certain embodiments, the switch 26 may be coupled to the component (e.g., magnetic piece 18 or the electromagnet 14) disposed within the stage prop 16 and may trigger the special effect 51 upon the coupling of the magnetic piece 18 and the electromagnet 14 of the stage prop 16 and the character costume 12.

Figure 8:
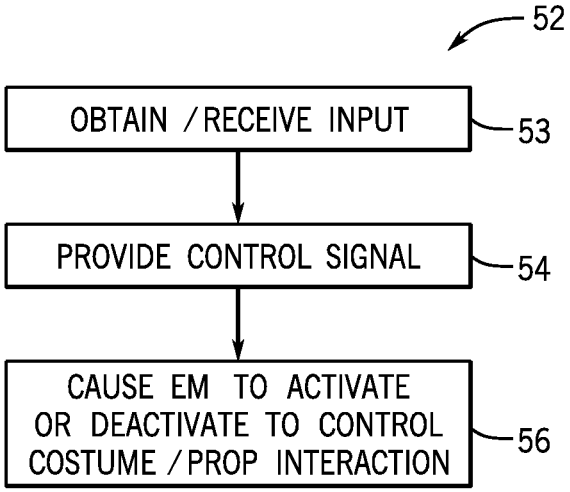
FIG. 8 is a flow chart of a method for controlling costume character interaction, in accordance with aspects of the present disclosure.

FIG. 8 is a flow chart of a method 52 for controlling costumed character interaction. The method 52 may be performed by one of the systems 10 described in FIGS. 1-3. The method 52 includes obtaining or receiving an input (at the control interface or a device in communication with the control interface) an input that affects the costumed character interaction (block 53). For example, an input may be obtained or received indicating that a guest present during the costumed character interaction has a certain standing or level that may facilitate a specific costumed character interaction or how the costumed character interaction may occur. For example, if a guest was at warlock level 8, this may enable the costumed character to succeed in a costumed character interaction (e.g., picking up a prop sword). In another example, an input may cause the costumed character interaction (e.g., event/coupling) to occur every fifth attempt or to occur randomly. The method 52 includes providing, via a control interface, a control signal to an electromagnet (block 54). In certain embodiments, the electromagnet may be integrated in a character costume by a person (e.g., entertainer). In certain embodiments, the electromagnet is disposed in a stage prop or show piece. The control interface may be located within or remote from the character costume or stage prop with the electromagnet. The control signal may be provided wirelessly or via a wired connection. The method 52 also includes causing the electromagnet to activate or to deactivate to control interaction between the character costume and the stage prop via the magnetic interaction between the electromagnet and a magnetic piece (e.g., permanent magnet or ferromagnetic material) (block 56). In certain embodiments, where the character costume has the electromagnet, the magnetic piece is disposed in or on the stage prop. In certain embodiments, where the stage prop has the electromagnet, the magnetic piece is disposed in the character costume (e.g., in an appendage, torso, head, or other component of the costume). The method 52 may include repeating the steps in blocks 54 and 56 to reverse the engagement or disengagement between the character costume and the stage prop. For example, if the first control signal caused the electromagnet to engage with the magnetic piece, then the second control signal causes the electromagnet to disengage with the magnetic piece. If the first control signal caused the electromagnet to disengage with the magnetic piece, then the second control signal causes the electromagnet to engage with the magnet (e.g., to form an electromagnetic lock). In certain embodiments, the activation of the electromagnet causes an attraction between the stage prop and the character costume (e.g., forming an electromagnetic lock). In certain embodiments, the activation of the electromagnet causes a repulsion between the stage prop and the character costume.

In certain embodiments, as noted above, a special effect generator may be coupled to an electromagnet (e.g., via a switch). In certain embodiments, upon the electromagnet forming a connection with a magnetic piece, the connection or the detection of the connection may provide a secondary activation of the special effect generator. For example, upon magnetic coupling a near field signal may be provided to cause the special effect generator to generate a special effect (e.g., ignite a flame effect or turn on a light). In another example, induction may power the generation of the special effect (via the special generator) due to electricity provided from the powered side (i.e., where the electromagnet is located) (e.g., either the character costume or the stage prop). In a further example, a pressure switch or some other sensor could be activated by the connection between the electromagnet and the magnetic piece to initiate the special effect via the special effect generator. In certain embodiments, a slight delay may occur (e.g., after the coupling between the electromagnet and the magnetic piece) before the special effect is generated. In certain embodiments, a simple communication link may be powered or established that enables a person in the character costume to activate the special effect when desired. In certain embodiments, the electromagnet may be directly coupled to the electromagnet (e.g., via the switch) and activation of the electromagnet may cause the special effect to be generated by the special effect generator.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features of the disclosed subject matter have been illustrated and described herein, many modifications and changes will occur to those skilled in the art. It is, therefore, to be understood that the appended claims are intended to cover all such modifications and changes as fall within the true spirit of the disclosed subject matter.

The invention claimed is:

1. A system for controlling costumed character interaction, the system comprising:

a character costume configured to be worn by a user;

an electromagnet integrated into the character costume;

a stage prop;

a magnetic piece integrated into the stage prop; and a control interface coupled to the electromagnet, wherein the control interface is configured, via a control signal, to activate and to deactivate the electromagnet to control interaction between the character costume and the stage prop via magnetic interaction between the electromagnet and the magnetic piece.

2. The system of claim 1, wherein the electromagnet is configured to cause disengagement between the character costume and the stage prop upon activation of the electromagnet in response to the control signal.

3. The system of claim 1, wherein the electromagnet is configured to cause engagement between the character costume and the stage prop to form an electromagnetic lock between the electromagnet and the magnetic piece upon activation of the electromagnet in response to the control signal.

4. The system of claim 1, wherein the control interface is disposed in the character costume.

5. The system of claim 1, wherein the control interface is physically coupled to the electromagnet.

6. The system of claim 1, wherein the control interface is configured to wirelessly control activation and deactivation of the electromagnet by controlling electrical power to the electromagnet.

7. The system of claim 6, wherein the control interface is located remote from the character costume.

8. The system of claim 6, the system comprising an additional stage prop comprising an additional electromagnet, wherein the stage prop comprises an additional magnetic piece, wherein the control interface is configured to wirelessly control activation and deactivation of the additional electromagnet to control interaction between the additional stage prop and the stage prop via magnetic interaction between the additional electromagnet and the additional magnetic piece.

9. The system of claim 1, wherein the stage prop comprises an additional electromagnet, a special effect generator, and a switch coupled to the additional electromagnet and the special effect generator, and wherein the control interface is configured to wirelessly control the additional electromagnet to control the special effect generator, via the switch, to generate a special effect.

10. The system of claim 1, wherein the electromagnet is located in an appendage of the character costume.

11. The system of claim 1, wherein the stage prop is part of scenery on a stage.

12. A system for controlling costumed character interaction, the system comprising:

a character costume configured to be worn by a user;

a magnetic piece integrated into the character costume;

a stage prop;

an electromagnet integrated into the stage prop; and a control interface coupled to the electromagnet, wherein the control interface is configured, via a control signal, to activate and to deactivate the electromagnet to control interaction between the stage prop and the character costume via magnetic interaction between the electromagnet and the magnetic piece.

13. The system of claim 12, wherein the electromagnet is configured to cause disengagement between the character costume and the stage prop upon activation of the electromagnet in response to the control signal.

14. The system of claim 12, wherein the electromagnet is configured to cause engagement between the character costume and the stage prop to form an electromagnetic lock between the electromagnet and the magnetic piece upon activation of the electromagnet in response to the control signal.

15. The system of claim 12, wherein the control interface is disposed in the stage prop.

16. The system of claim 12, wherein the control interface is configured to wirelessly control activation and deactivation of the electromagnet by controlling electrical power to the electromagnet.

17. The system of claim 12, wherein the stage prop comprises an additional electromagnet, a special effect generator, and a switch coupled to the additional electromagnet and the special effect generator, and wherein the control interface is configured to wirelessly control the additional electromagnet to control the special effect generator, via the switch, to generate a special effect.

18. The system of claim 12, wherein the magnet piece is located in an appendage of the character costume.

19. A method for controlling costumed character interaction, the method comprising:

providing, via a control interface, a control signal to an electromagnet integrated into a character costume worn by a user; and in response to the control signal, causing the electromagnet either to activate or to deactivate to control interaction between the character costume and a stage prop comprising a magnetic piece via magnetic interaction between the electromagnet and the magnetic piece.

20. The method of claim 19, wherein providing, via the control interface, the control signal comprises wirelessly providing the control signal to the electromagnet.

* * * * *